United States Patent [19]

Egbert et al.

[11] 4,394,012

[45] Jul. 19, 1983

[54] WEIGHTED EXERCISE VEST

[76] Inventors: Jeffrey T. Egbert, 22 College Ave., Rexburg, Id. 83440; Jason S. Egbert, 5036 Whitaker, Pocatello, Id. 83201

[21] Appl. No.: 275,914

[22] Filed: Jun. 22, 1981

[51] Int. Cl.[3] ..... A63B 21/12

[52] U.S. Cl. ..... 272/119; 2/251; 2/250

[58] Field of Search ..... 272/119, 117, 93; 2/82, 2/250, 253, 251; 128/25 R, DIG. 15

[56] References Cited

U.S. PATENT DOCUMENTS

| | | | |
|---|---|---|---|
| 1,427,499 | 6/1922 | Spear | 2/250 |
| 3,759,510 | 9/1973 | Jackson | 272/119 X |
| 4,268,917 | 5/1981 | Massey | 272/119 X |

FOREIGN PATENT DOCUMENTS

| | | | |
|---|---|---|---|
| 5960 | of 1903 | United Kingdom | 272/119 |

*Primary Examiner*—Richard C. Pinkham

*Assistant Examiner*—William R. Browne

*Attorney, Agent, or Firm*—Thorpe, North & Western

[57] ABSTRACT

An exercise vest that selectively allows weight capsules to be inserted into pockets thereof. The vest material overlaps in the front and includes a fastening device for securely wrapping and holding the vest around the chest, back and shoulders of its wearer. The weight capsules are of a uniform size and shape and fit snugly into the weight pockets. Each weight capsule has at least one weight securely held therewithin. All weights used in connection with the weight capsules are of a uniform size and mass. A wide range of weights may be placed within the vest by selectively inserting a desired number of weight capsules, each having a desired number of weights therein, into the weight pockets of the vest. The vest allows free movement of the arms and is adapted to be worn while participating in conventional athletic activities, such as volleyball, basketball, racquetball, tennis and the like.

20 Claims, 9 Drawing Figures

WEIGHTED EXERCISE VEST

BACKGROUND OF THE INVENTION

This invention relates to exercises devices, and more particularly to an exercise vest adapted to receive and carry a plurality of weights, and further adapted to be worn while participating in other athletic-type activities, thereby providing an excellent cardiovascular-respiratory-neuro-muscular exercise to the user of such a vest.

It is known in the prior art to attach weights of different types and shapes to a garment so as to realize an exercise garment wherein resistance to muscle action is increased by the weights carried by the garment. U.S. Pat. No. 3,759,510 is exemplary in this respect in that it teaches an exercise garment with several components. When all the components are connected, the wearer thereof resembles an astronaut wearing a space suit, and his movement is severely restricted. Each component of the exercise garment has a plurality of pockets into which bean-bag type weights may be inserted. A large variety of weights, both as to shape and density, must be kept on hand if the total weight carried by the garment is to be variable. This patent specifically teaches that the partial filling of any weight pocket is not desirable, since this permits shifting of the weight material in the pocket as the user engages in the motion of exercise, and such shifting interferes with the movements or balance of the user. As mentioned, to overcome this problem, the patent teaches using pockets of various sizes, and maintaining a wide range of weights, in adequately small increments, and by selecting the weight materials used in these weights to be of variable densities.

U.S. Pat. No. 4,239,211 further teaches the use of weights in a spaced-apart relationship, which weights may be encapsulated in a closed cell material and worn about desired portions of the body. Unfortunately, such encapsulation of the weights makes it difficult to vary the amount of weights which are carried in the encapsulation. Thus, a user of the weighted material is severely restricted in amount of weights which he can carry at any given time. Further, the bulk of the weighted web in which the encapsulated weights are carried may severely restrict those portions of the body where it can be comfortably worn while still engaging in other active pursuits.

SUMMARY OF THE INVENTION

It is a first object of the present invention to provide an exercise vest that builds and tones muscles at the same time that a wearer thereof is participating in other desired activities, such as athletic events.

It is a second object of the present invention to provide such an exercise vest that is not large and cumbersome to wear, and that permits free arm and body movement, thereby allowing a wearer thereof to engage in almost any type of athletic activity.

A third object of the present invention is to provide such an exercise vest that allows a wide range of weights to be added thereto by selectively inserting weight modules of a common size into pockets contained therein.

A fourth object of the present invention is to provide such an exercise vest that maintains essentially the same bulk regardless of the amount of weights that have been inserted therein.

A fifth object of the present invention is to provide an exercise vest that prevents the undesirable shifting of weights as a user of the vest actively moves his body as he participates in other activities, such as athletic events.

A sixth object of the present invention is provide an exercise vest that can be adapted to receive and carry weights of a common size and mass, thereby facilitating the manufacture, distribution, and storage of such weights.

A seventh object of the present invention is to provide an exercise vest that is adjustable in size, thereby allowing one or two vest sizes to adjustably fit all body sizes.

An eighth object of the present invention is to provide such an exercise vest that is comfortable to wear, and that doesn't restrict body movement, breathing, or cause chaffing or other skin or body irritation.

A ninth object of the present invention is to provide such a vest that may be easily cleaned, and from which the weights may be easily removed.

A tenth object of the present invention is to provide a method of cardiovascular-respiratory-neuro-muscular exercise that may be undertaken concurrently while participating in other athletic activities.

The above and other objects of the present invention are realized in an illustrative embodiment that includes a vest adapted to be worn about the chest, back, and shoulders of a user thereof. The vest is preferrably of a type that overlaps in the front, or chest portion, and such overlap permits the vest to be comfortably worn regardless of the body size of the user.

Uniformly distributed about the front and back of the vest are a plurality of weight pockets. Weight modules may be selectively placed inside these weight pockets in order to add a desired amount of weight to the vest. Each weight module is configured to fill its respective weight pocket, thus preventing undesirable movement of the weight module once it has been inserted into the weight pocket.

Each weight module has selectively placed therein a desired number of weights. The interior of the weight module is configured to securely hold these weights and prevent their movement within the module. All weights used within the modules are of a common size and mass, thereby facilitating their manufacture, distribution and storage.

In a preferred embodiment of the invention, the weight modules may be selectively opened so that the desired number of weights may be placed therein. Once inserted into a weight pocket on the vest, the weight modules will define the maximum bulk that the vest can assume regardless of the amount of weights inside of the modules.

A preferred embodiment of the vest is realized using materials that are readily available and machine washable, thereby allowing easy cleaning and care of the vest. Further, the vest is designed to be very comfortable in wearing, and particular care is taken to allow free breathing and free movement of the arms and torso of a user thereof.

The exercise method disclosed herein includes wearing the vest, placing a desired number of weight modules, in each weight module having a desired number of weights of a common size and mass placed therein, and participating in any desired athletic event, such as racquetball, tennis, basketball, or the like. By so engaging in such athletic activity while wearing the weighted vest, an excellent cardiovascular-respiratory-neuromuscular workout is achieved. Moreover, such a workout is achieved in the environment of an enjoyable athletic activity.

BRIEF DESCRIPTION OF THE DRAWINGS

The above and other objects, features, and advantages of the invention will be more apparent from the following detailed description of the invention, presented in connection with the accompanying drawings, in which.

DETAILED DESCRIPTION OF THE INVENTION

The invention is best understood by reference to the figures wherein like numerals will be used to designate like parts throughout.

Figure 1:
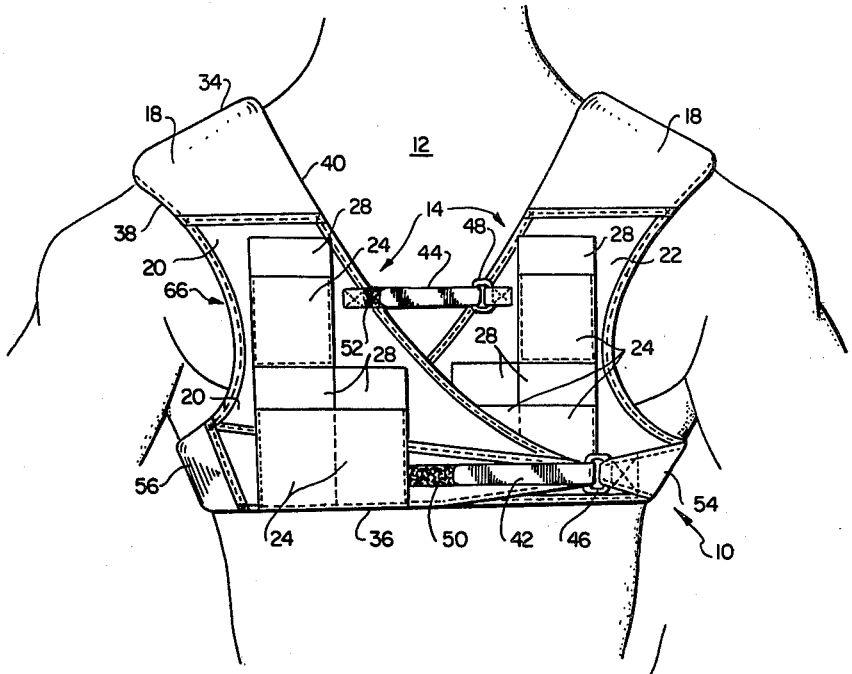
FIG. 1 is an exercise vest of the type disclosed herein as viewed from the front, or chest side of a wearer thereof.
Figure 2:
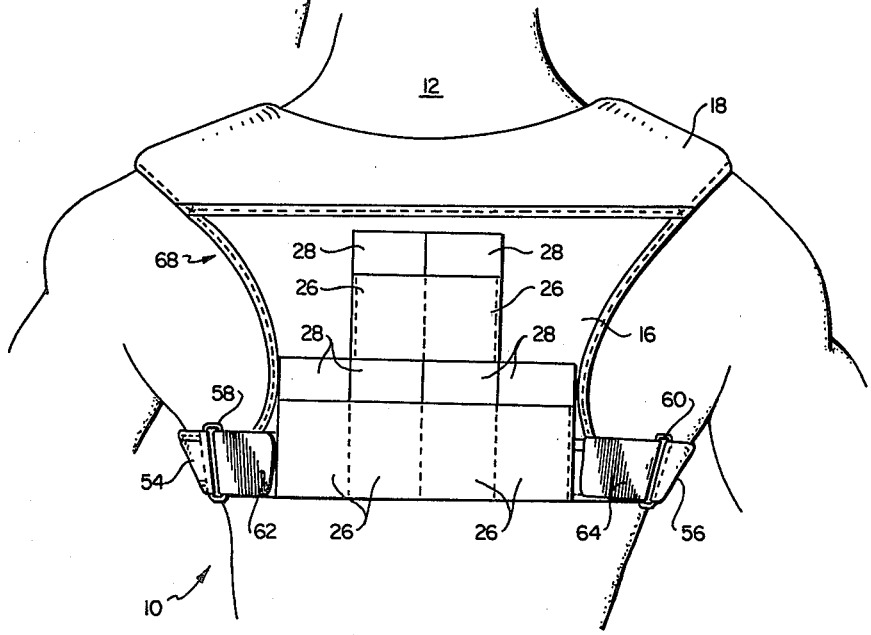
FIG. 2 is the vest of FIG. 1 as viewed from the back side of a wearer thereof.
Figure 3:
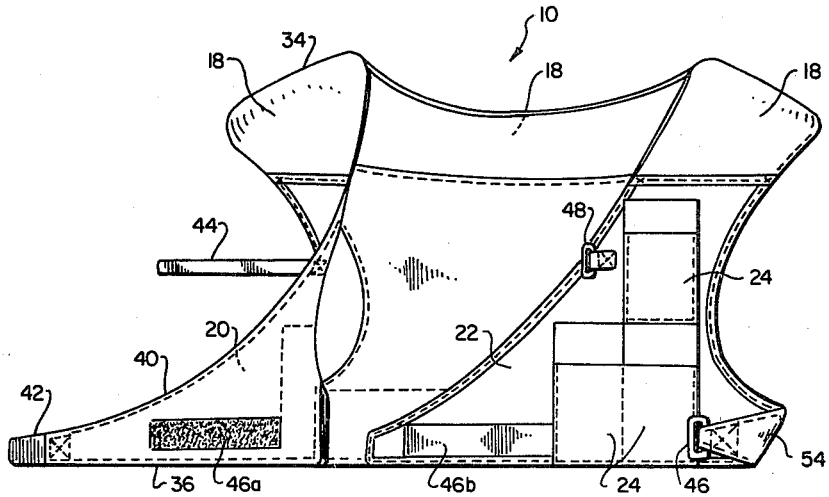
FIG. 3 is a front view of the vest of FIG. 1 with one of the front flaps of the vest opened up so as to illustrate a preferred method for securing the front flaps one to the other.

Referring first to FIGS. 1, 2, and 3, there is shown an exercise vest 10 adapted to be worn about the chest, back, and shoulders of a wearer 12 thereof. Correspondingly, the vest includes a front, or chest, portion 14, a back portion 16, and a shoulder portion 18. The front portion 14 further includes a right flap 20 and a left flap 22. As shown best in FIG. 3, the right flap 20 is adapted to overlap the left flap 22, as will be more fully described below.

The front flaps 20 and 22 each contain weight pockets 24 affixed thereto. In the preferred embodiment, these weight pockets are positioned on the front flaps 20 and 22 so as to form two rows of pockets on each front flap, a lower row contains two pockets, while the upper row contains one pocket. Similar weight pockets 26 are affixed to the back portion 16 of the vest 10. These back pockets 26 are likewise positioned in two rows. The lower row contains four pockets, and the upper row contains two pockets.

Figure 4:
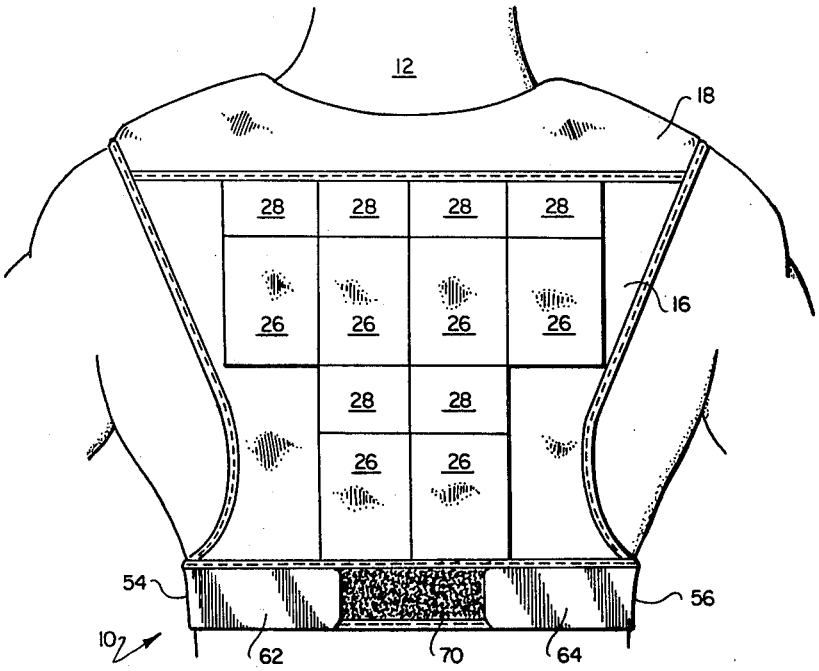
FIG. 4 is an alternative embodiment of the back of the vest of FIG. 1.

For an alternative embodiment of the back pockets, see FIG. 4. To facilitate the fabrication of the vest 10, the pockets 24 and 26 are simply sewn onto their respective portions of the vest material. This vest material may be, in the preferred embodiment, a heavy duty, non-bias, nylon, or any other suitable fabric material, such as corduroy. Such material is easy to work with and may be used with an inside lining material, if needed, so that the vest feels comfortable against the skin when worn.

The positioning of the front pockets 24 and the rear pockets 26 is symmetrical. Such symmetrical placement of the pockets allows a uniform distribution of the weights to be inserted thereinto if desired. However, if a non-uniform distribution of weights is desired, then all that is required is to selectively insert the weights into the pockets 24 or 26 in a non-uniform fashion. For example, if for some reason it is desired to build the muscles on the right front side of the wearer 12, then the wearer need only insert weights into the pockets 24 of the right front flap 20. As desired, weights may also selectively be placed in corresponding pockets 26 on the back portion 16 of the vest 10.

Each pocket 24 or 26 has a means for closing the same. In the preferred embodiment, this closing means may be realized with a pocket flap 28 adapted to fold over and close the open upper portion of the pockets 24 and 26 in conventional manner. Any suitable means may be used to secure the pocket flaps 28 in a closed position. In the preferred embodiment, suitable strips of fibrous loop material and resilient hook material may be respectively sewn on the upper portion of the pockets and the back side of the flaps 28. When such strips are pressed together, the resilient hooks become sufficiently entangled with the fibrous loops so as to form a secure, yet detachable bond. Such fibrous loop material and resilient hook material is commercially available under the tradename of Velcro.

Straps 30 and 32 are used to secure the right front flap 20 of the vest 10 to the left front flap 22. As seen in both FIG. 1 and FIG. 3, both the right front flap 20 and the left front flap 22 have roughly the appearance of a quadrilateral. That is, in connection with the right front flap 20, there is an upper short side 34 that passes over the shoulder of the wearer 12. A lower long side 36 passes across the lower chest of the wearer 12. An inwardly curving, or concave, side 38 connects the outer end of the short upper side 34 to a corresponding end of the longer lower side 36. Finally, a long diagonal side 40 connects the inside end of the short upper end 34 to a corresponding end of the lower long side 36. The left front flap 22 has similar sides associated therewith, the left flap 22 being approximately the mirror image of the right front flap 20 as viewed in FIG. 1.

The inwardly concave sloping side 38 of the right flap 20, and the corresponding side of the left flap 22, are adapted to allow the free movement of the arms of the wearer 12. It is particularly important for the wearer 12 to be able to freely swing his arms as is required, for example, while participating in athletic events such as racquetball, basketball, tennis, and the like.

The front flap 20 is secured to the front flap 22 by means of straps 42 and 44, as well as by securing means **46*a* and 46*b* (FIG. 3). The strap 42 is affixed to the right front flap 20 so as to form an extension of the corner where sloping diagonal side 40 and the long lower side 36 meet. In turn, strap 44 is affixed approximately midway along the diagonal side 40 of the right flap 20. A rigid loop 46 is affixed to the lower outer portion of the left flap 22. Similarly, a rigid loop 48 is affixed approximately midway along the diagonally sloping side of the left flap 22. These loops are adapted to have the straps 42 and 44 inserted therethrough. The strap 42, for example, passes through the loop 46 and is doubled back on itself, and is secured to the lower portion of the right flap 20. Similarly, the strap 44 passes through the loop 48 and is doubled back on itself and secured. In the preferred embodiment, a strip of fibrous loop material 50 is positioned on the lower front flap 20 so as to be aligned with the strap 42 once this strap has been inserted through the buckle 46. On the back side of the strap 42 (not shown) a strip of resilient hook material is secured, which resilient hook material is adapted to be entangled with the fibrous loop material 50 to form a secure yet detachable bond. A similar strip of fibrous loop material 52 and resilient hook material (not shown) may be used in connection with the strap 44 in order for this strap to be secured once it has been inserted through the loop 48. Further, a strip of fibrous loop material 46*a* may be positioned on the inside of the right flap 20 as shown in FIG. 3. A corresponding strip of resilient hook material 46*b* may be secured to the lower portion of the left flap 22 so as to be juxtaposed from the resilient hook material 46*a* when the vest is worn and the flaps 20 and 22 are overlapped. These strips of fibrous loop material 46*a* and resilient hook material 46*b* thus provide an additional means of securing the vest 10 about the chest, shoulders, and back of the wearer 12. The resilient hook material and the fibrous loop material described above in connection with the strips 46*a* and 46*b*, as well as the straps 44 and 42, may be realized using commercially available Velcro. It is to be understood, that the positioning of the fibrous loop material and the resilient hook material is interchangeable. Thus, for example, the strip 46*a* shown in FIG. 3 could be the resilient hook material, while the strip 46*b*** could be the fibrous loop material, as well as visa versa.

The vest includes under-arm straps 54 and 56. The under-arm strap 54, in the preferred embodiment, passes under the left arm of the wearer 12, while the under-arm strap 56 passes under the right arm. Advantageously, the strap 56 is realized from a stretchable material, such as stretch webbing, commercially available from numerous fabric supply houses. These staps 54 and 56 are adjustably connected to the back portion 16 of the vest as shown in FIG. 2. This adjustable connection includes rigid loops 58 and 60 to which the under-arm straps 54 and 56 are permanently attached. Passing through the loop 58 is a lower back strap 62 that is doubled back on itself and secured in much the same fashion as is front strap 44. That is, a strip of resilient hook material (not shown) is affixed to a back side of the strip 62 so as to be juxtaposed from a strip of fibrous loop material (also not shown), thereby enabling the strip 62 to be detachably secured. However, by adjusting the strap 62, the effective length of the under-arm strap 54 may be adjusted to a desired length. Similarly, a lower back strap 64 is used in connection with the loop 60 and the under-arm strap 56 in order to allow the effective length of the under-arm strap 56 to be selectively adjusted.

It will be appreciated that the multiple adjustments provided by use of the back straps 62 and 64, as well as the adjustments made possible through the use of the front straps 42 and 44, used in conjunction with the securing means **46*a* and 46*b*, provides an adjustable vest 10 that can fit almost any size rib cage. Thus one or two sizes of the vest 10 is all that is required to be manufactured and sold. These adjustments, of course, work in cooperation one with the other. Typically, the adjustment of the under-arm straps 54 and 56 is a first stage adjustment, while the adjustment of the straps 42 and 44** is a second stage adjustment.

The rigid loops 46, 48, 58, and 60 are preferrably realized from nylon or plastic. Such materials do not irritate the skin, and facilitate the washing of the vest. Such plastic or nylon loops or buckles are readily available from numerous manufacturers.

The basic material used to realize the vest 10, such as the heavy duty, non-bias, nylon referred to previously, or other suitable material, is hemmed along the edges thereof as shown, for example, at 66 (FIG. 1) and 68 (FIG. 2). All such hems incorporated into the vest 10 are turned away from the wearer 12 so as to reduce chaffing of the wearer's skin. Such hems or seams may be realized by simply turning out the material and sewing it with a suitable thread. A heavy duty nylon thread, typically used for tent making, has been found suitable for this use, as well as for the other uses associated with the fabrication of the vest. Thus, such thread may be used not only for forming the hems 66 and 68, and the like, but also to sew on the pockets 26 and 24, affix the loops or buckles 46, 48, 58, and 60, to their respective locations, affix the Velcro or similar strips to their desired locations, and so forth. If desired, a separate material may also be folded and sewn around the edges of the basic material in order to form an attractive and strong hem. As mentioned, a suitable lining material may also be sewn to the inside of the vest so as to make the wearing thereof more comfortable when the vest is worn against bare skin.

FIG. 4 depicts an alternative embodiment of the back portion 16 of the vest 10. In this alternative embodiment, the back pockets 26 are arranged in a different configuration from that shown in FIG. 2. In particular, only two weight pockets 26 are included in a lower row across the back portion 16, while four weight pockets 26 are included in an upper row of such pockets. This arrangement allows a slightly different distribution, although still a symmetrical distribution, of the weight that is placed across the back. Further, the alternative embodiment of FIG. 4 allows the vest 10 to be slightly longer and facilitates the use of an alternative embodiment for adjusting the under-arm straps 54 and 56. In particular, this alternative embodiment employs a long strip of fibrous loop material 70 affixed across the entire length of a bottom edge of the back portion 16. To this continuous strip of fibrous loop material 70, the back lower straps 62 and 64 may be selectively engaged. About three inches of resilient hook material is included on the back side of the ends of the straps 62 and 64, and these hooks are adapted to engage with the fibrous loop material as above described.

Figure 5:
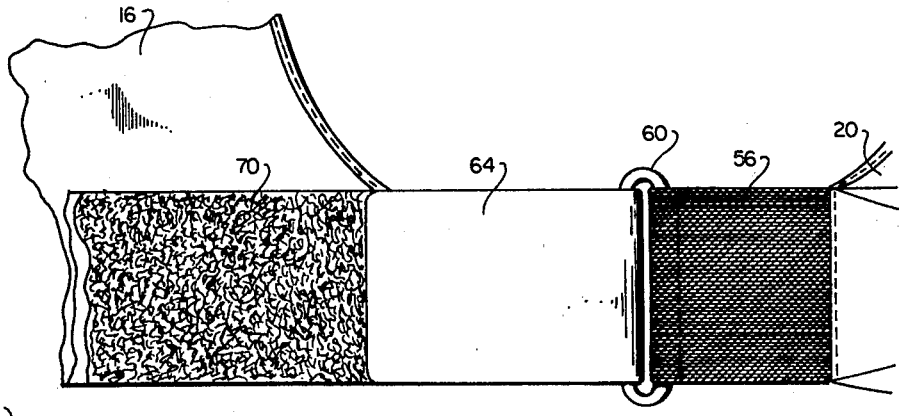
FIG. 5 is a side view that further details the alternative embodiment of FIG. 4.

FIG. 5 is a side view that further details the alternative embodiment of FIG. 4. Use of this alternative embodiment, allows the first stage adjustment to cover a wider range.

Figure 6B:
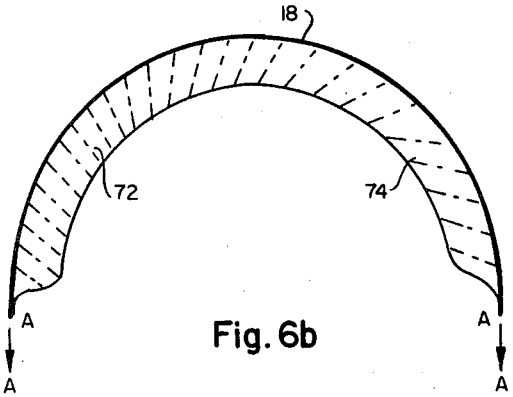
FIGS. 6A and 6B show cross-sectional views of the shoulder portion of the vest of FIG. 1, FIG. 6A showing the shoulder portion when held in a straight position, and FIG. 6B showing the shoulder portion as it would appear when curved about the shoulder of a wearer of the vest.
Figure 6A:
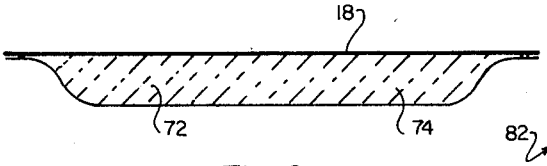

In FIGS. **6*a* and 6*b* there is shown a cross-sectional view of the shoulder portion 18 of the vest 10. A padding material 72 is inserted on the underneath side of the shoulder portion 18. A lining material 74 is employed to hold the padding material 72 in its desired position. As seen best in FIG. 6*b*, the weight or stress will pull on the shoulder portion 18 in the direction as shown by the arrows A—A. There is no stress or weight placed on the lining material 74, nor on the padding material 72. Any suitable lining material, such as light-weight nylon, may be used to realize the lining material 74. Similarly, the padding 72** may be realized using any suitable material, such as foam rubber.

Figure 7:
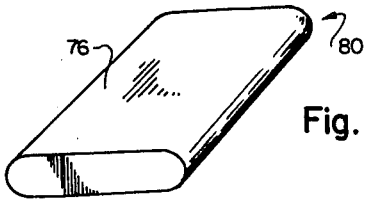
FIG. 7 is a perspective view of a weight that is utilized in the preferred embodiment of the invention.

In FIG. 7 there is shown a perspective view of a weight 76 that may be realized with the present invention. A preferred material from which the weight 76 could be realized is lead. In a preferred embodiment, the weight 76 will have a mass of approximately 1.0–1.25 (454–567 grams) and will have dimensions of roughly 1.5–2.0 inches long by 1.0–2.0 inches wide by ¼–½ inches thick. The weight may be a continuous solid block, or it may have holes or cavities therein in order to realize the desired mass.

Figure 8:
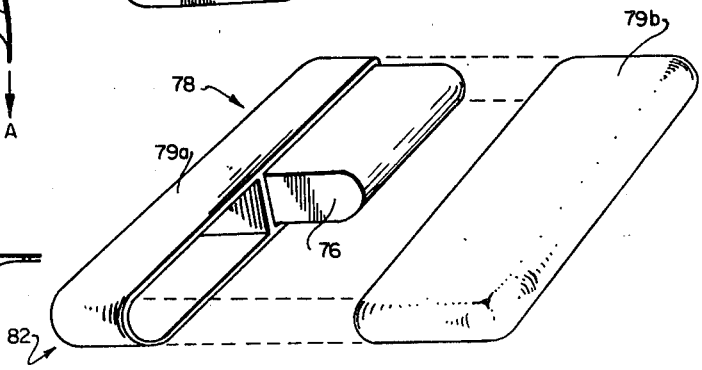
FIG. 8 is a perspective view showing the weight of FIG. 4 inserted into a weight module, half of the weight module being removed for clarity, which weight is adapted to be removably inserted into the pockets of the vest of FIG. 1.

In FIG. 8, the weight module 78 is shown into which the weight 76 is to be inserted. In the preferred embodiment, the weight module 78 has two compartments therein, thereby allowing up to two of the weights 76 to be inserted therein. The weight module 78 is preferrably adapted to open, as shown in FIG. 8 (with respective halves 79*a* and 79*b* being shown separated from each other) to facilitate the insertion of the weight 76 therein. Thus, as desired, each weight module 78 may have from 1.0–1.25 or 2.0–2.5 pounds of weight contained therein.

The weight module 78 is preferrably realized from a light-weight durable material such as plastic. Any flaking of the lead weight 76 will be contained within the module 78, and such flakings will not, therefore, contaminate the inside of the weight pockets 24 and 26 (which contamination would make the cleaning of the vest 10 a more forminable job). The dimensions of the preferred embodiment of the weight module 78 are roughly 3.0–4.0 inches long by 2.0–4.0 inches wide by ¼–½ inches thick.

As seen best in FIG. 8, the weights 76 are shaped so as to exactly fill one compartment inside of the weight module 78. In the preferred embodiment, the weights 76 have smooth rounded edges and corners as shown at 80. The weight module 78, in turn, has rounded edges and corners, as shown at 82, which are adapted to interface with the rounded edges and corners of the weight 76. Thus, once the weight 76 is inserted into the weight module 78, the weight 76 is secured on all sides by the walls of the module 78, and is not allowed to move in any direction. Similarly, the pockets 24 and 26 employed on the vest 10 are sized so that the weight modules 78 just fit therewithin, thus preventing any movement of the weight module 78 once inserted into its respective weight pocket. Thus, once the weights 76 are inserted into their respective weight modules 78, and the weight modules 78 are, in turn, inserted into their respective weight pockets 24 or 26, there can be no undesirable shifting of the weights carried within the vest. Further, with a weight module 78 placed in a pocket of the vest, that pocket will have assumed the maximum bulk that it will ever assume, whether such weight module be empty, or whether it contains a maximum number of weights therein.

As mentioned, the preferred embodiment of the invention contemplates using weights 76 that have a mass of roughly 1.0–1.25 pounds. By selectively using the six front pockets 24 and the six back pockets 26 in connection with the weights 76 and the weight module 78, it can be seen that the weight carried by the vest can be varied from 0 pounds up to 24 pounds (assuming each weight is 1.0 pound) in increments of 1.0 pounds. If this weight is to be uniformly distributed, then a weight inserted on one side of the vest will have to be counterbalanced by a weight inserted on the other side of the vest. In such a situation, the total weight carried by the vest can still be varied from 0 lbs. to 24 pounds in increments of 2 pounds. Such a variation will meet the needs of most users of such a vest.

In use, the vest 10 may be used by any person desiring a good cardiovascular-respiratory-neuro-muscular workout who also wants to engage in a fun and/or competitive athletic event. The exercise vest gives its wearer an advantage while participating in whatever athletic event he desires, such as racquetball, tennis, basketball, or the like. The wearer can build up a resistance to the added weight to the upper regions of his body while maintaining the pursuit of athletic excellence in his chosen endeavor. Weight resistance of the order disclosed allows the wearer total freedom of movement. The wearer is not restricted from swinging a racquet or a bat, from making a basket, or touching his toes, and yet the wearer can give himself a weight resistance which he must overcome by development of his muscles, which development will increase his quickness. This is because, of course, the body reacts to the weight resistance by becoming stronger and quicker in order to compensate for the lack of ability caused by the added weights. After wearing the vest for a suitable period of time, the wearer will soon be up to his previous athletic achievements without the vest, and then when he removes the vest, as he would in a competitive athletic event, for example, his body will still be conditioned but he will move much quicker and with less effort. The athlete may gradually build up to whatever degree of excellence he desires to achieve by merely slowly increasing the amounts of weights which are carried in the vest.

The exercise vest of the type disclosed herein may also advantageously be used as physical therapy to strengthen a particular portion or section of the body. For example, if an athlete were to injure his left shoulder or arm, he may, by use of the vest and by inserting weights therein so as to be non-uniformly distributed to his left side, give the added resistance to his left arm and shoulder that are needed to allow the arm and shoulder to quickly develop back to their previous state.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

What is claimed is:

1. An exercise vest adapted to be worn about the chest, back and shoulders of the wearer thereof comprising:

(a) a contoured shoulder fabric portion adapted to be worn about the back of the neck and over shoulders of the wearer terminating in a horizontal lower back edge and a pair of horizontal lower front edges;

(b) a trapezoidal back fabric portion terminating in parallel top and bottom edges and symmetrical generally downwardly and inwardly tapered side edges, said top edge being continguous with and sewn to the lower back edge of said shoulder portion;

(c) a fabric chest portion comprising right and left flaps adapted to overlap across the chest of the wearer, said right flaps and left flaps being essentially mirror image of each other, each flap being generally trapezoidal in shape having top and bottom parallel edges, said bottom edge being greater in length than said top edge, an outer generally vertical side edge connecting the outermost ends of said top and bottom edges and an inner generally diagonal edge connecting the innermost ends of said top and bottom edges, said inner diagonal edge being greater in length than said outer vertical side edge, said top edges being continguous with and sewn to the lower front edges of said shoulder portion;

(d) a pair of adjustable strap securing means interconnecting the lowermost portions of said tapered side edges of said back portion with the lowermost portion of said outer generally vertical side edges of said right and left flaps of said chest portion;

(e) fastening means for securing said flaps of said chest portion in an overlapping position across the chest of the wearer comprising a pair of straps located on one flap of said chest portion, one strap being affixed at the corner formed by the juncture of the inner diagonal and lower edges of the flap so as to form an extension of said corner and the other strap being affixed along said inner diagonal edge approximately midway between said top and bottom edges, and a corresponding pair of strap receiving loops located on the opposite flap, one of said receiving loops being affixed near the corner formed by the juncture of the outer vertical side edge and the bottom edge and the other receiving loop being affixed along said diagonal edge approximately midway between said top and bottom edges, said straps containing means to secure each strap in a fixed position after said strap has passed through its corresponding receiving loop;

(f) a plurality of weight pockets affixed to said back and chest portions, said weight pockets being of a uniform size and being uniformly distributed thereon;

(g) a plurality of weight modules adapted to be selectively and removably inserted into said weight pockets, each of said weight modules being configured to have a size and shape that fills said weight pockets, said weight modules thereby being constrained from all movement once inserted inside one of said pockets; and (h) a plurality of identical weights, each of said weights being of a uniform size and mass, and being adapted to be securely held inside of said weight modules.

2. An exercise vest as defined in claim 1 wherein said generally vertical side edges of said right and left flaps curve inwardly towards the center of the chest of said wearer in concave fashion, said concave slope facilitating the moving and swinging of the arms of said wearer.

3. An exercise vest as defined in claim 2 wherein said means for securing the straps of the fastening means in a fixed position comprises strips of fibrous loop material and resilient hook material selectively affixed to one side of said straps and, if necessary, to the flap to which said straps are affixed, said straps being positioned such that the fibrous loop material will become engaged with the resilient hook material when said straps have been inserted through said loops and doubled back in an overlapping relationship.

4. An exercise vest as defined in claim 3 wherein said right and left flaps each have three weight pockets affixed thereto, and wherein said back portion has six weight pockets affixed thereto.

5. An exercise vest as defined in claim 4 wherein two of the weight pockets affixed to each to said right and left flap members are positioned side-by-side in a lower row, and the remaining third weight pocket is positioned above said lower row.

6. An exercise vest as defined in claim 5 wherein four of the weight pockets affixed to said back portion are centrally positioned side by side in a back lower row, and the remaining two weight pockets are centrally positioned side by side above said back lower row.

7. An exercise vest as defined in claim 5 wherein four of the weight pockets affixed to said back portion are centrally positioned side-by-side in a back upper row, and the remaining two weight pockets are centrally positioned side-by-side below said back upper row.

8. An exercise vest as defined in claim 3 wherein said weight capsules comprise a generally rectangularly shaped holder having smooth, rounded corners, said holder having two equally sized compartments formed therein, each of said compartments being adapted to securely hold one of said identical weights so as to prevent all movement of said weight once inserted into its respective compartment.

9. An exercise vest as defined in claim 8 wherein said rectangular holder may be selectively opened, thereby allowing a desired number of weights to be placed therein.

10. An exercise vest as defined in claim 9 wherein each of said weight capsules is adapted to hold no more than two of said identical weights.

11. An exercise vest as defined in claim 10 wherein each of said identical weights has a mass of 1.0–1.25 pounds, or 454–567 grams.

12. An exercise vest as defined in claim 3 wherein each of said adjustable strap securing means interconnecting said right and left flaps of said chest portion with said back portion are adapted to allow the length of each strap to be selectively adjusted.

13. An exercise vest as defined in claim 12 wherein each of said straps is at least partially made from a stretchable material.

14. An exercise vest as defined in claim 13 further including padding material affixed to the underneath side of the shoulder portion of said vest adapted to come in contact with the shoulders of said wearer.

15. An exercise vest as defined in claim 14 further including an additional material attached to the underneath sides of said shoulder portion to which said padding is affixed, said padding material being sandwiched between said shoulder portion and said additional material.

16. An exercise vest as defined in claim 15 wherein said shoulder, back and chest portions are made from a heavy duty, non-bias nylon and said additional material is made from a lightweight nylon adapted for use as a lining material.

17. An exercise vest as defined in claim 15 wherein a heavy duty thread is used to affix said additional material to said shoulder portion, as well as to affix said weight pockets, straps, and the like to said back and chest portions, said thread also being used to hem all portions of said vest.

18. An exercise vest as defined in claim 17 wherein the hems of said vest further include a third material folded and sewn around desired edges thereof.

19. An exercise vest as defined in claim 3 wherein said chest portion contains an additional fastening means for securing said flaps of said chest portion in a fixed overlapping position which comprises securing means for securing the outward side of the corner portion formed by the juncture of the bottom and inner diagonal edges of the flap containing the strap receiving loop to the inward side of the corner portion formed by the juncture of the bottom and vertical side edges of the flap containing the pair of straps, said outward and inward sides being defined relative to whether said sides face outwardly from or inwardly to the body of said wearer when said vest is worn.

20. An exercise vest as defined in claim 19 wherein said additional fastening means comprises securing means consisting of strips of fibrous material and resilient hook material selectively affixed to said corner portions of said flaps in the positions indicated, the fibrous loop material being affixed to one flap and the resilient hook material being affixed to the other flap, said strips being positioned so as to be juxtaposed one from the other such that the hooks and loops thereof become entangled and form a secure yet releasable bond when said vest is worn.

* * * * *